US006105587A

United States Patent [19]

Dunn

[11] Patent Number: 6,105,587

[45] Date of Patent: Aug. 22, 2000

[54] DISPOSABLE, FINGER WORN TOOTHBRUSH

[76] Inventor: Gary D. Dunn, 2368 Podocarpus Way, Clearwater, Fla. 34619

[21] Appl. No.: 09/109,901

[22] Filed: Jul. 2, 1998

[51] Int. Cl.[7] ..... A45D 44/18; A46B 9/04; B65D 83/10

[52] U.S. Cl. ..... 132/309; 15/167.1; 15/188; 15/227; 206/362.2; 206/362.4

[58] Field of Search ..... 15/167.1, 184, 15/186, 188, 227, 104.94; 132/308, 309; 401/132; 206/362.2, 362.4

[56] References Cited

U.S. PATENT DOCUMENTS

| | | | |
|---|---|---|---|
| 2,419,896 | 4/1947 | Hobelmann | 15/167.1 |
| 2,763,885 | 9/1956 | Lyons | 15/167.1 |
| 2,900,650 | 8/1959 | Rivero | 15/167.1 |
| 3,070,102 | 12/1962 | MacDonald . | |
| 3,298,507 | 1/1967 | Micciche . | |
| 3,368,668 | 2/1968 | Micciche . | |
| 3,675,264 | 7/1972 | Storandt . | |
| 3,952,867 | 4/1976 | McCord . | |
| 4,134,172 | 1/1979 | Arce . | |
| 4,530,129 | 7/1985 | Labick et al. | 15/184 |
| 5,068,941 | 12/1991 | Dunn . | |
| 5,074,414 | 12/1991 | Romana | 15/184 |
| 5,107,562 | 4/1992 | Dunn . | |
| 5,213,428 | 5/1993 | Salman | 15/167.1 |
| 5,348,153 | 9/1994 | Cole | 15/167.1 |
| 5,392,482 | 2/1995 | Drulias et al. | 15/167.1 |
| 5,440,774 | 8/1995 | Cole | 15/167.1 |
| 5,487,201 | 1/1996 | Hansen et al. | 15/104.94 |
| 5,605,756 | 2/1997 | Sanduja et al. | 15/167.1 |
| 5,678,273 | 10/1997 | Porcelli | 15/167.1 |
| 5,819,765 | 10/1998 | Mittiga | 15/227 |
| 5,909,739 | 6/1999 | Masrour-Rad | 15/167.1 |

FOREIGN PATENT DOCUMENTS

| | | |
|---|---|---|
| 2243072 | 10/1991 | United Kingdom . |
| WO 94/02048 | 2/1994 | WIPO . |

*Primary Examiner*—Robert J. Warden, Sr.
*Assistant Examiner*—Andrew Aldag
*Attorney, Agent, or Firm*—Terrance L. Siemens

[57] ABSTRACT

A flexible, disposable toothbrush and hygiene kit incorporating the same. The toothbrush comprises an elastomeric sheath which can be slipped over the user's finger. A patch of bristles is located on the closed end of the sheath. Constituent material of the sheath is thin, flexible, and capable of receiving and maintaining indicia printed in ink. The constituent material of the sheath or the bristles or both is impregnated with a flavoring agent. The toothbrush may be incorporated into a kit providing dentifrice stored in a readily frangible capsule and dental floss.

2 Claims, 2 Drawing Sheets

DISPOSABLE, FINGER WORN TOOTHBRUSH

BACKGROUND OF THE INVENTION

1. Field of the Invention

The present invention relates to disposable toothbrushes of the type having structure enabling the toothbrush to be slipped over and supported on one finger.

2. Description of the Prior Art

Non-rigid personal hygiene articles such as toothbrushes are quite useful in certain situations. If adapted to fit over a person's finger and rely upon the finger for form holding support, a toothbrush may be quite compact when folded for storage, and may be quite inexpensive. Flexible, disposable toothbrushes have been proposed in the prior art. Examples are seen in my prior U.S. Pat. Nos. 5,068,941, issued Dec. 3, 1991, and 5,107,562, issued Apr. 28, 1992, and in other prior patents. A representative selection of the latter includes U.S. Pat. Nos. 3,070,102, issued to Harold B. MacDonald on Dec. 25, 1962, 3,298,507 and 3,368,668, issued to Frank Micciche on Jan. 17, 1967 and Feb. 13, 1968, and 4,134,172, issued to Oscar A. Arce on Jan. 16, 1979.

These prior art patents lack the improvements of the present invention, these being impregnation of the constituent material with a flavoring agent, fabrication from a printable material and inclusion of indicia on the disposable toothbrush, and the kit of the present invention. The kit includes ancillary hygienic devices, such as dental floss and a frangible capsule of dentifrice. Dental floss is described in U.S. Pat. No. 3,675,264, issued to Duane L. Storandt on Jul. 11, 1972, but not as an element separate and apart from a disposable toothbrush, as seen in the present invention. A capsule of dentifrice is shown in U.S. Pat. No. 3,952,867, issued to William F. McCord on Apr. 27, 1976, but not as part of a kit as shown herein. In McCord's toothbrush, the capsule is located apart from the bristles, and must be applied to the teeth or to that portion of the mouth receiving hygienic attention. By contrast, the capsule of the present invention is disposed adjacent the bristles, requiring only breaking of the encapsulating membrane to render the dentifrice fully and immediately usable.

None of the above inventions and patents, taken either singly or in combination, is seen to describe the instant invention as claimed.

SUMMARY OF THE INVENTION

The present invention sets forth a disposable toothbrush which improves over prior art flexible, disposable toothbrushes in several ways, and a kit incorporating the same. Disposable toothbrushes are desirable in certain situations. For example, a toothbrush comprising a flexible sheath may be folded for storage quite compactly. This characteristic serves well in situations such as packing a MRE (meal ready to eat) for military personnel. The need for personal hygiene is frequently overlooked or regarded as a dispensable luxury when military considerations have priority over personal desires. Compactness of a foldable toothbrush formed from thin walled stock material substantially overcomes unfeasibility of including a toothbrush with a MRE. Flaccidity is also useful in providing a toothbrush to incarcerated prisoners which cannot readily be converted into a pointed weapon. In the latter instance, both flaccidity and compactness are useful.

The novel toothbrush provides the ability to print indicia thereon. This may be useful in various situations. Where an inexpensive disposable toothbrush is provided as a premium for advertising purposes, identity of the supplier or of that party conducting the advertising is thereby disseminated to consumers. The indicia may also be useful in institutional situations. For example, instructions may be printed thereon.

Another feature of the novel toothbrush is impregnating the constituent material of the brush or bristles or both with a flavoring agent. The flavoring agent may serve to induce those not normally inclined to practice adequate personal hygiene to engage in such hygiene. The flavoring may also overcome inhibitions regarding employing a dentifrice having an unpleasant taste, or may be used to overcome taste of other agents included with the dentifrice. For example, antibacterial materials may be rendered palatable by the flavoring agent.

The invention may be practiced as a kit incorporating the novel toothbrush in addition to other supplies. These other supplies may include dental floss and dentifrice separately packaged. Where the dentifrice is separately packaged, it is preferably furnished in a readily frangible capsule.

Accordingly, it is one object of the invention to provide a toothbrush which is highly compact when stored and inexpensive to manufacture.

It is another object of the invention that the toothbrush be maintained in a sanitary state prior to use.

It is a further object of the invention to enable display of indicia upon the toothbrush.

Still another object of the invention is to provide a flavoring agent integral with the toothbrush.

An additional object of the invention is to provide a personal hygiene kit offering amenities in addition to just a toothbrush.

It is again an object of the invention to provide dentifrice in a readily usable condition.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
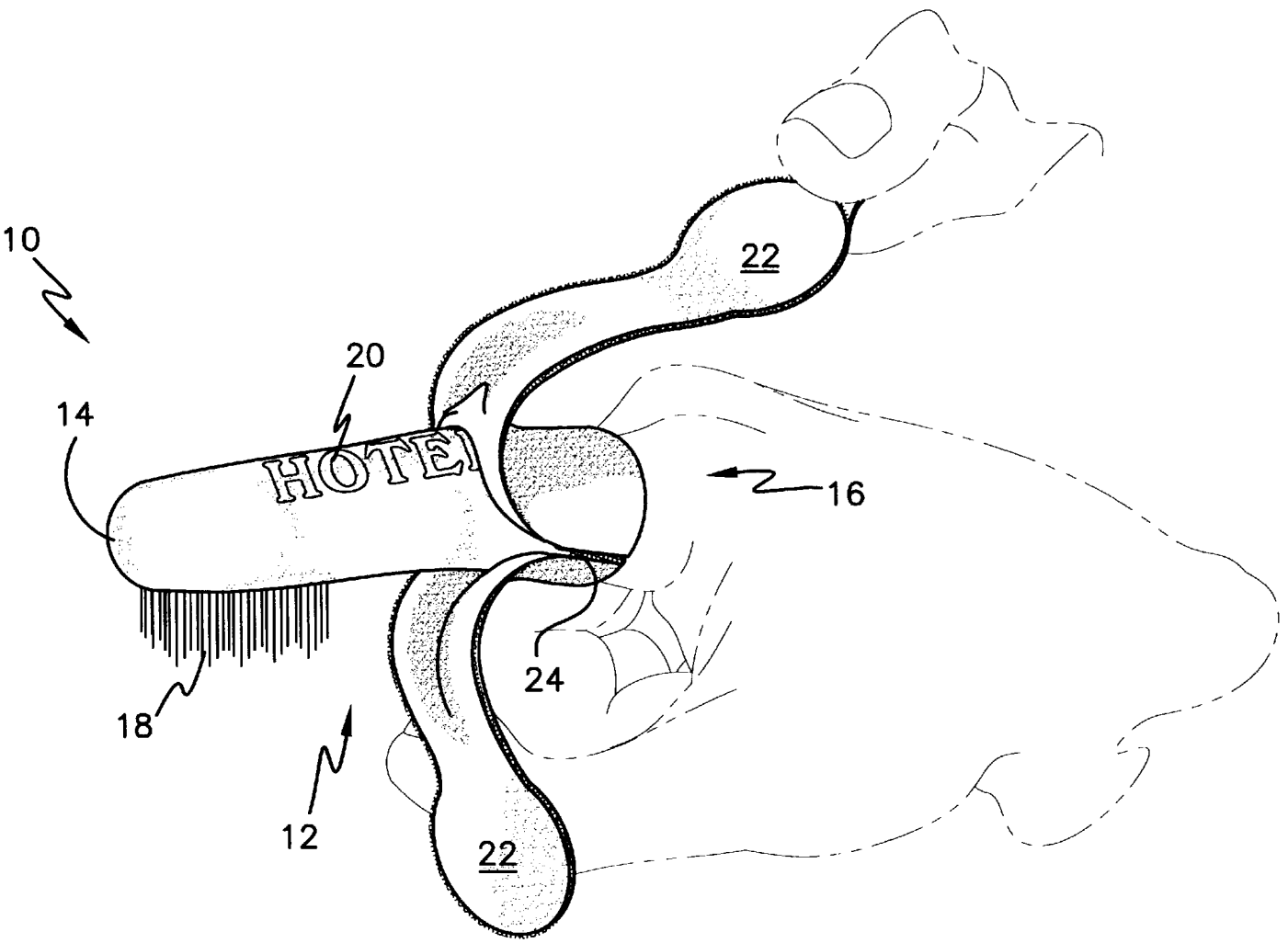
FIG. 1 is an environmental, perspective view of the novel toothbrush.

The novel disposable toothbrush 10 is shown in FIG. 1 to comprise a sheath 12 having a circumferential wall having a closed proximal end 14 and an open distal end 16. Bristles 18 of any suitable type are disposed upon sheath 12 at closed proximal end 14. Bristles 18 may, for example, comprise individual filaments, or may take another form, such as patches of artificial sponge or open cell material having greater rigidity than that of sheath 12. Sheath 12 and bristles 18 may be of a type shown in either one of my prior U.S. Pat. Nos. 5,068,941, issued Dec. 3, 1991, and 5,107,562, issued Apr. 28, 1992, both of which are explicitly incorporated herein by reference. While the overall structure and configuration of toothbrush 10 may be as shown in my prior patents, sheath 12 of the present invention is formed from a resilient, flexible elastomer capable of receiving and retaining indicia 20 which is printed in ink thereon. Of course, indicia 20 may be printed on a surface of sheath 12 which is visible prior to opening or unfolding sheath 12.

In the embodiment depicted in FIG. 1, sheath 12 is formed to include flaps 22 joined by frangible seams 24. Seams 24 may be formed by adhesive, by ultrasonic or thermal welding, or in any other suitable manner. Flaps 22 enclose sheath 12 to form a flexible extension wrapped around and enclosing sheath 12 against exposure to the exterior. Seams 24 serve the function of providing a removable closure enabling sheath 12 to be made accessible for use as a toothbrush. It will be appreciated from examining FIG. 1 that the interior surface of sheath 12 in the initial, unopened condition becomes an exterior surface after sheath 12 is opened or unfolded by pulling back flaps 22.

The constituent elastomer or other material of sheath 12 and bristles 18 is impregnated with a flavoring agent (not separately shown). A suitable flavoring agent is available from Flavor Materials International of Avenel, N.J. For example, natural spearmint flavoring is available in powder form as product PK-19159 SD or as an oil soluble liquid as product PK-1951.

Figure 2:
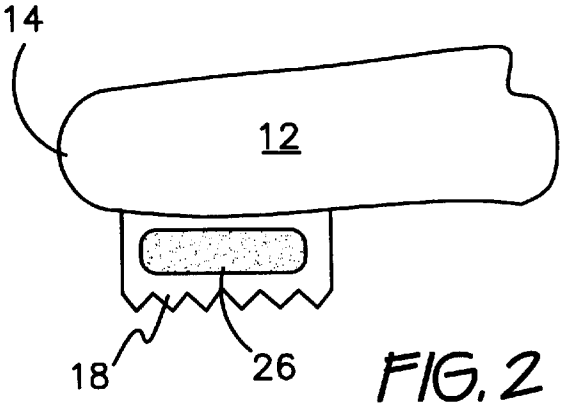
FIG. 2 is an environmental, side elevational detail view of an alternative embodiment of FIG. 1.

Optionally, as shown in FIG. 2, a frangible capsule 26 of toothpaste or any other suitable dentifrice is provided on sheath 12 at bristles 18. Capsule 26 is fabricated from a thin material, such as cellulosic films, which will break responsive to bristles 18 being pressed against the teeth or gums of the user's mouth (not shown) with sufficient force to bend bristles 18.

Figure 3:
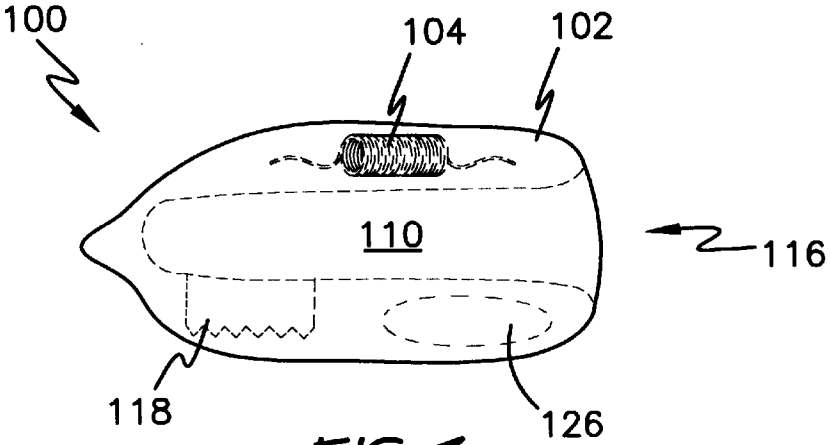
FIG. 3 is a side elevational view of a kit incorporating the novel toothbrush.
Figure 4:
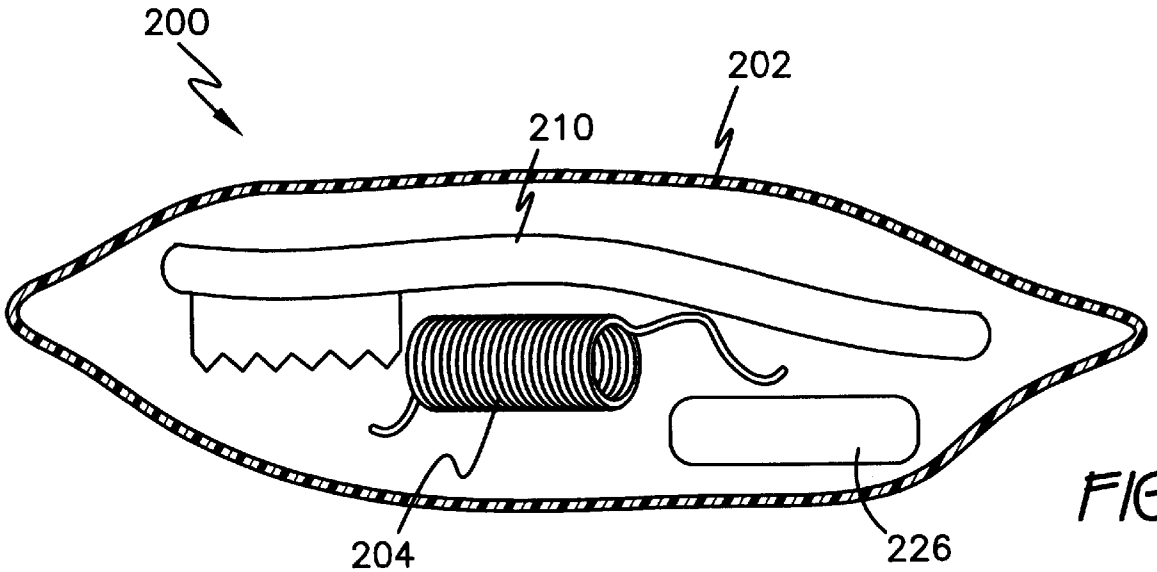
FIG. 4 is a side elevational view of an alternative embodiment of a kit incorporating the novel toothbrush.

The invention may take the form of a kit 100 or 200, as shown respectively in FIGS. 3 and 4. In kit 100, a flexible covering or outer envelope 102 formed integrally with sheath 110 protects contents from contamination. Envelope 102 is similar to that provided by flaps 22 of the embodiment of FIG. 1, but is enlarged to accommodate other contents in a single, common compartment. These contents include a length of dental floss 104, depicted in a coiled condition, and a capsule 126 of dentifrice.

In the embodiment of FIG. 4, kit 200 has a flexible covering or outer envelope 202 which is separate and apart from any part of toothbrush 210. Toothbrush 210 is essentially similar to toothbrush 10 of the embodiment of FIG. 1. Kit 200 includes dental floss 204 essentially similar to dental floss 104 of the embodiment of FIG. 3, and a capsule 226 of dentifrice which is essentially similar to capsule 126 of the embodiment of FIG. 3.

Kits 100, 200 employ thin walled, flexible materials, with the exception of bristles, which must be of rigidity greater than that of sheath 10, 110, or 210 and the envelope 102 or 202, dental floss 104 or 204, and capsule 126 or 226. Kits 100, 200 are therefore very compact when folded for storage, inexpensive, and may be regarded as disposable.

It is to be understood that the present invention is not limited to the embodiments described above, but encompasses any and all embodiments within the scope of the following claims.

I claim:

1. A disposable kit enabling a person to practice oral hygiene, comprising:

a toothbrush comprising a sheath having a circumferential wall enclosing an interior, a closed proximal end and an open distal end, and bristles disposed upon said closed proximal end, said sheath formed from a resilient, flexible elastomer, and wherein said bristles have rigidity greater than that of said sheath;

a length of dental floss;

a capsule of toothpaste which will break under pressure sufficient to bend said bristles; and a flexible covering entirely enclosing and sealing said dental floss, said capsule of toothpaste, and the closed proximal end of said sheath in a single, common compartment, wherein said covering includes a plurality of flaps joined at one end by frangible seams disposed to form a flexible extension wrapped around and enclosing said dental floss, said capsule and the closed proximal end of said sheath, thereby providing a removable closure having a single compartment and enabling said sheath to be made accessible for use as a toothbrush, said flaps being attached at another end to the open distal end of said sheath.

2. The kit according to claim 1, wherein said elastomer is a type capable of receiving and retaining indicia printed in ink on said elastomer.

* * * * *